US008525690B2

(12) United States Patent
Puro et al.

(10) Patent No.: US 8,525,690 B2
(45) Date of Patent: Sep. 3, 2013

(54) SYNCHRONIZED TELEMETRY FROM A ROTATING ELEMENT

(75) Inventors: William J. Puro, Rocky Hill, CT (US); Phillip T. Harkawik, Fairfield, CT (US)

(73) Assignee: APS Technology, Inc., Wallingford, CT (US)

( * ) Notice: Subject to any disclaimer, the term of this patent is extended or adjusted under 35 U.S.C. 154(b) by 171 days.

(21) Appl. No.: 12/389,950

(22) Filed: Feb. 20, 2009

(65) Prior Publication Data

US 2010/0214121 A1 Aug. 26, 2010

(51) Int. Cl.

| | |
|---|---|
| ***G01V 3/00*** | (2006.01) |
| ***G01S 3/80*** | (2006.01) |
| ***E21B 3/02*** | (2006.01) |

(52) U.S. Cl.

USPC ..... 340/854.5; 340/853.2; 340/854.3; 367/119; 367/120; 367/128; 175/121

(58) Field of Classification Search

USPC ..... 343/720, 757, 759, 763, 766, 768; 340/853.1, 853.2, 853.9, 854.1, 854.2, 854.3, 340/855.4, 855.8, 854.6; 367/82, 119, 124, 367/127, 128, 138; 175/26–27, 45, 104, 175/121; 166/250.1; 702/41, 57, 145, 150; 342/350, 385, 417, 428; 375/354–377

See application file for complete search history.

(56) References Cited

U.S. PATENT DOCUMENTS

| | | | | |
|---|---|---|---|---|
| 3,968,473 | A | 7/1976 | Patton et al. | |
| 4,285,236 | A * | 8/1981 | Chien | 73/152.49 |
| 4,303,994 | A | 12/1981 | Tanguy | |
| 4,324,297 | A | 4/1982 | Denison | |
| 4,359,898 | A | 11/1982 | Tanguy et al. | |
| 4,445,578 | A | 5/1984 | Millheim | |
| 4,479,564 | A | 10/1984 | Tanguy | |
| 4,662,458 | A | 5/1987 | Ho | |
| 4,715,451 | A | 12/1987 | Bseisu et al. | |
| 4,739,841 | A | 4/1988 | Das | |

(Continued)

FOREIGN PATENT DOCUMENTS

WO PCT/US10/24642 8/2010

OTHER PUBLICATIONS

Notification of Transmittal of the International Search Report and the Written Opinion of the International Searching Authority mailed Apr. 23, 2010.

(Continued)

*Primary Examiner* — Hai Phan
*Assistant Examiner* — Franklin Balseca
(74) *Attorney, Agent, or Firm* — Woodcock Washburn LLP

(57) ABSTRACT

A top drive assembly may comprise a drive motor that provides rotational torque to a drill string for driving the drill string into the earth. A sensor and a transmitter may be located on a section of the drill string or on a device that can be incorporated into a drill string. The sensor may take measurements of the drill string that is rotating during the drilling operation. If the sensor is located near the top drive assembly, the sensor may take measurements of an upper portion of the rotating drill string during the drilling operation. The transmitter may wirelessly transmit the sensor information in real-time to a coordinator or main radio. The transmitter may also be located near the top drive assembly and during the drilling operation, may transmit from the rotating drill string while located in a position above the earth's surface.

5 Claims, 7 Drawing Sheets

(56) References Cited

U.S. PATENT DOCUMENTS

| | | | | |
|---|---|---|---|---|
| 4,760,735 | A | 8/1988 | Sheppard et al. | |
| 4,802,143 | A | 1/1989 | Smith | |
| 4,821,563 | A | 4/1989 | Maron | |
| 4,958,517 | A | 9/1990 | Maron | |
| 5,144,298 | A * | 9/1992 | Henneuse | 340/854.6 |
| 5,251,708 | A | 10/1993 | Perry et al. | |
| 5,386,724 | A | 2/1995 | Das et al. | |
| 6,068,394 | A | 5/2000 | Dublin | |
| 6,216,533 | B1 | 4/2001 | Woloson et al. | |
| 6,547,016 | B2 | 4/2003 | Wassell | |
| 6,967,589 | B1 * | 11/2005 | Peters | 340/854.6 |
| 7,654,158 | B2 | 2/2010 | Weems | |
| 7,654,340 | B2 | 2/2010 | Self et al. | |
| 2006/0290528 | A1 * | 12/2006 | MacPherson et al. | 340/853.1 |
| 2007/0029113 | A1 * | 2/2007 | Chen | 175/45 |
| 2007/0030167 | A1 * | 2/2007 | Li et al. | 340/855.1 |
| 2007/0187148 | A1 | 8/2007 | Self et al. | |
| 2008/0168827 | A1 | 7/2008 | Weems | |
| 2008/0277166 | A1 | 11/2008 | Orban et al. | |

OTHER PUBLICATIONS

Written Opinion of the International Searching Authority mailed Apr. 23, 2010.

* cited by examiner

SYNCHRONIZED TELEMETRY FROM A ROTATING ELEMENT

TECHNICAL FIELD

The disclosed techniques are directed to an apparatus for taking measurements from a drill string during a drilling operation. More specifically, the disclosed techniques are directed to taking measurements from a portion of a drill string that is rotating, typically above the surface of the earth, and transmitting those measurements to a remote location during the drilling operation.

BACKGROUND

In underground drilling, such as gas, oil, or geothermal drilling, a bore is drilled through a formation deep in the earth. Such bores are formed by connecting a drill bit to sections of long pipe, referred to as a drill pipe, that are connected so as to form an assembly commonly referred to as a drill string. The drill string may extend from above the surface of the earth to the bottom of the bore. A drill platform or drill rig is a structure used to house machinery for drilling.

Often, a drilling system utilizes a top drive motor to drill wells. Top drive motors are mounted in the drilling mast of the drilling rig and typically raised and lowered in the mast by a rail system. The top drive motors may be a power, electrical, or hydraulic motor, for example, and may provide a motive force to rotate the drill string. The distal end of the drill string may be referred to as the bottom hole assembly or downhole assembly. The downhole assembly may include a drill bit that advances to form a bore in the surrounding formation.

A portion of the downhole assembly may incorporate an electronic system with sensing modules for taking measurements downhole. For example, measurements with respect to the drill bit may help the operator direct the drill bit properly. The sensing modules in the bottom hole assembly may transmit the collected information to the surface such that they may be analyzed by a drill operator for controlling the drilling process. Information may be transmitted to the surface via pressure pulses in drilling fluid, for example, or the sensors may be analyzed once they are pulled up out of the downhole assembly during a break in the drilling operation. The operator may use the information related to the downhole operations to modify the drilling operation, such as to control the direction in which the drill bit advances in a steerable drill string, for example.

SUMMARY

Disclosed herein are techniques for transmitting both downhole and uphole measurements from an uphole location during the drilling operation from a transmitter that is rotating with the drill string. A sensor, located on a section of the drill string or on a device that can be incorporated into the drill string, may receive downhole information or measure uphole information. A transmitter located uphole may wirelessly transmit the sensor information in real- or near real-time during the drilling operation to a coordinator or main radio, for example, that may be located a distance away from the sensing equipment.

The uphole measurements may be of the drill string that is in proximity to the top drive assembly during the drilling operation. For example, if the sensor is located uphole on the drill string near the top drive assembly, the sensor may take measurements of the upper portion of the drill string during the drilling operation. The sensor may measure weight, bending, or torque of the drill string at this location.

Mounted at the bottom of the drill string may be a bottom hole assembly that takes measurements, processes, and stores information about the downhole drilling operation. A surface assembly may relay downhole sensing information from the sensing equipment downhole to the uphole sensor and/or transmitter 4. The uphole sensor can receive the downhole information using known methods (e.g., through the pressure pulses in the drilling fluid). The uphole sensor can use a radio frequency link to transmit the downhole information to a coordinator while rotating during the drilling operation.

Power efficiency has great impact on the battery life of the power source that powers the sensor and transmitter, and, thus, is another important issue in a wireless system. Typically, long hours of operation are desired and often a limited power source is used to power the sensor and transmitter. Because the drill string is rotating, efficient transmission of the sensor information may be crucial for conserving power. Transmitting over a portion of the arc of the transmitter's rotational path conserves power. Thus, the transmitter may be configured to transmit the information at select times or over a select arc of the transmitter's rotational path. Transmission times may be synchronized with the receiving antenna such that transmissions occur when the receiving antenna is visible to the transmitter.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

The foregoing Summary, as well as the following Detailed Description of illustrative embodiments, is better understood when read in conjunction with the appended drawings. For the purpose of illustrating the embodiments, there are shown in the drawings example constructions of the embodiments; however, the embodiments are not limited to the specific methods and instrumentalities disclosed. In the drawings.

DETAILED DESCRIPTION OF ILLUSTRATIVE EMBODIMENTS

Disclosed herein are techniques for transmitting uphole and downhole measurements during a drilling operation from a transmitter located uphole and rotating with the drill string. A method for synchronizing data transmissions between a rotating transmitter and a stationary antenna may support the uphole transmission of information associated with the drilling operation. The techniques may optimize efficiency and minimize the amount of power required. For example, the timing of the transmission of data from a rotating transmitter on an upper portion of the drill string to a stationary antenna may be such that transmission occurs over a portion of the rotating path, thereby saving power. Several techniques may be employed to determine the appropriate arc in the rotational path through which transmission of data should occur.

The aspects summarized above can be embodied in various forms. The following description shows, by way of illustration, combinations and configurations of a drilling system and a rotating element in which the aspects can be practiced. It is understood that the described aspects and/or embodiments are merely examples. It is also understood that other aspects and/or embodiments can be utilized, and structural and functional modifications can be made, without departing from the scope of the present disclosure. For example, although some aspects herein relate to methods of transmitting data from a rotating element in a mud pulse drilling operation, it should be noted that transmission of data from the rotating element may be employed in a variety of drilling systems, such as a kelly drilling system, or the like.

Figure 1:
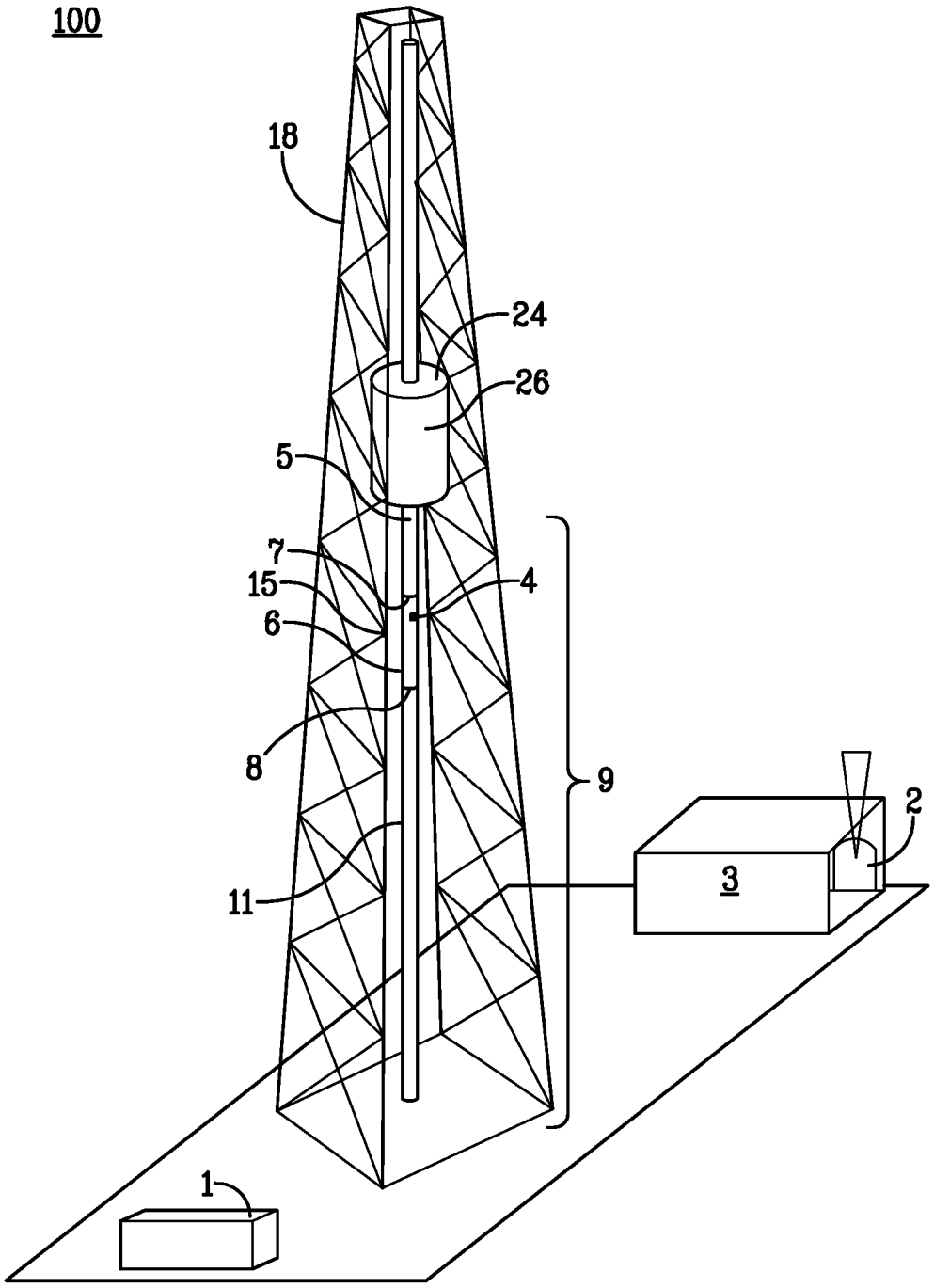
FIG. 1 depicts an example top drive drilling system capable of wireless networking capabilities that may be used with the disclosed techniques.

FIG. 1 depicts an example drilling system 100 that utilizes the disclosed techniques to wirelessly transmit information to a remote location when the drill string 9 is rotating (i.e., during the drilling operation). The example drilling system 100 depicts a simplified view of the drilling components that may be utilized and includes a rig structure 18, a top drive assembly 24 with a drive motor 26, a fixed radio coordinator 15, a cabin 3, a device 6, and a drill string 9 (with drill pipe sections 5 and 11). In this example configuration, a device 6 is shown configured similar to a drill pipe and is incorporated into the drill string 9. The device 6 may include a transmitter 4.

The top drive assembly 24 with the drive motor 26 may provide rotational torque to the drill string 9 for driving the drill string 9 into the earth to drill a well. The top drive assembly 24 is lowered with respect to a rig structure, driving the drill string 9 into the earth as it is lowered, until the top drive assembly 24 gets close to the rig floor or the surface of the earth. Thus, the top drive assembly 24, and an upper portion of the rotating drill string 9, typically operate at a point above the surface of the earth while drilling the drill string downward into the earth.

A device 6 may be incorporated into the drill string 9. The device 6 may include a sensor or another type of electronics for sensing, such as a microcomputer or the like. The sensor may rotate with the drill string 9 during the drilling operation and take uphole measurements related to the drilling operation. The uphole measurements may be measurements of the portion of the drill string 9 that is in proximity to the top drive assembly during the drilling operation. For example, the sensor, located in proximity to the top drive motor 26, may measure weight, bending, torque, or rotational speed of the drill string 9 at this location. Thus, the sensor may take uphole measurements of the drill string 9 itself during the drilling operation. Typically, uphole information comprises measurements of the various parameters of the drilling components that operate above the surface of the earth or above the surface of the rig structure.

Mounted at the bottom of the drill string may be a bottom hole assembly that takes measurements, processes, and stores information about the downhole drilling operation. A surface assembly may relay downhole sensing information from the sensing equipment downhole to the uphole sensor and/or transmitter 4. The uphole sensor can receive the downhole information using known methods (e.g., through the pressure pulses in the drilling fluid) and then use a radio frequency link to transmit the downhole information to a coordinator, while rotating and during the drilling operation, by utilizing the disclosed techniques.

A transmitter located uphole on the device 6 may wirelessly transmit the sensor information in real- or near real-time during the drilling operation to a coordinator 15 or main radio, for example, that may be located a distance away from the sensing equipment. The transmitter 4, may be a transceiver that may both receive information and also transmit the measurements. A coordinator 15 may be a fixed location radio or antenna that is located in close proximity to the drill rig (e.g., 10 feet) or it may be a moving antenna. The transmitter 4 may wirelessly transmit the sensor information in real-time to the coordinator 15, for example. The transmitter 4 may be configured to rotate uphole with a portion of the drill string 9 that rotates above the surface of the earth during the drill operation.

The drill string 9 may be formed in the usual manner of interconnecting a large number of drill pipes 5, 11. A device 6 may be incorporated into the drill string 9. In FIG. 1 the device 6 is configured similarly to a drill pipe such that the device 6 can connect at a first end to the uppermost drill pipe 5 and at a second end to a second drill pipe 11 in the drill string 9. Thus, device 6 is tooled similar to a drill pipe 5, 11 and is part of the interconnection of pipes 5, 11 that make up the drill string 9. Other methods of incorporating the device 6 into the drill string 9 are contemplated. For example, the device 6 may be coupled to the uppermost drill pipe 5 or be otherwise incorporated between the top drive motor 26 and the drill string 9.

The drill string comprises pipes 5 and 11. The device 6 may be coupled to a portion of the drill string that rotates uphole during the drilling operation. For example, the device could be coupled or otherwise affixed to drill pipe 5. As shown in FIG. 1, the device may be a component that is configured like a pipe, and the pipes 5, 11 and the device 6 may be interconnected at threaded joints 7, 8. The lowermost pipe, which may be drill pipe 11, may have a drill bit attached to the end for drilling into the earth. The top drive motor 26 may connect directly or indirectly to one of the uppermost drill pipes 11 in the drill string 9, such as drill pipe 5, to provide rotational torque to the string 9. In an example configuration, the uppermost drill pipe 5 directly connects to the top drive motor 26.

Thus, the components of device 6 may be coupled to the drill string 9 or the device 6 may itself be configured similarly to a section of drill string 9 (e.g., configured like a drill pipe). Because the upper portion of the drill string 9 is often in a position above the surface of the earth 40 during the drilling operation, the transmitter 4 may be located uphole and be available to transmit wirelessly to a remote location at any time during the drilling operation.

The device's transmitter 4, the coordinator 15, router 1, and cabin 3 may communicate via a wireless network, for example. The coordinator 15 may be located as far away as suitable to receive the measurements transmitted from the device's transmitter 4. The coordinator 15 may transmit the measurements received to another antenna, which is typically located even further away from the rig structure 18 than the coordinator 15. For example, the cabin 3 may include a second antenna that receives the information from the coordinator 15. The cabin 3 may have a processing unit that further processes and evaluates the information from the device's transceiver 4. An operator may be able to view and manipulate data from inside the cabin 3.

There may be several coordinators, antennas, or end users/computers that may be available to receive the information from the device's transmitter 4. The coordinator 15 and/or the end user/computer within the cabin 3 may make the information available via a network. Additionally, a router 1 may receive the transmission from the coordinator 15 and forward the information to an appropriate remote location. For example, the router 1 may determine the next network point to which the information should be forwarded, thus determining which way to send the information. The router may create and maintain a table of the available routes any conditions or restrictions and use this information to determine the best route for a given packet of information. Often, information will travel through a number of network points with routers before arriving at its destination.

The device's transmitter 4, the coordinator 15, router 1, cabin 3 may communicate via a wireless network. The wireless networking system may use an industry standard IEEE 802.15.4 protocol to transmit data to an end user or computer, such as a processing unit in the cabin 3. Communication may occur in three different bands in the IEEE 802.15.4 protocol. Often, the band chosen is 2.4 GHz, which is open for use in most countries. The IEEE 802.15.4 is physical radio standard developed for low data rates and battery operation. However, it is contemplated that any industry standard suitable to be used with the techniques disclosed herein may transmit data to an end user or computer. For example, another protocol called ZigBee uses the IEEE 802.15.4 standard as a baseline and can add routing and networking capability. Routing capability in drilling system 100 may be provided by router 1, for example. Mesh networking may be added to the IEEE 802.15.4 protocol to continue forwarding messages to an end user. For example, intermediate radios may be in place to continue forwarding messages to an end user if line of site or point to point communications are disrupted.

Transmission by the device's transceiver 4 may be synchronized with the coordinator 15 or receiving antenna. The device's transceiver 4 may conduct a search to determine if any receiving antennas are visible. In this manner, the device 6's antenna may be operable to receive one or more control signals being communicated from a coordinator 15. For example, the device's transceiver 4 may monitor beacon signals transmitted by a plurality of coordinators to determine the visibility of each coordinator 15 to the device 6. The search may be focused based on information resulting from prior beacon signal transmissions.

Figure 2:
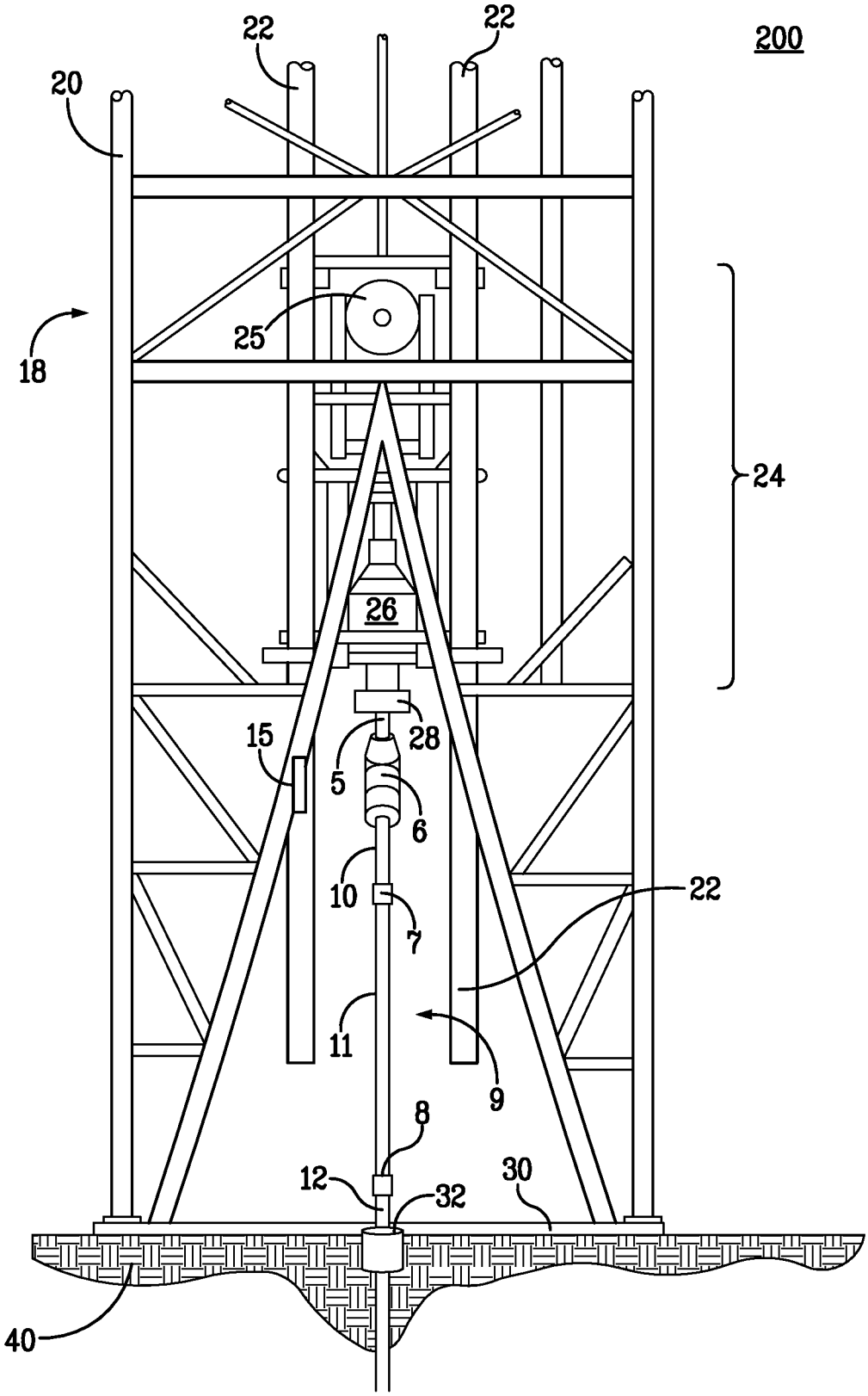
FIG. 2 depicts a portion of an example rig structure for a top drive drilling system that incorporates a device capable of performing the disclosed techniques.

FIG. 2 depicts an example rig structure 18 for a top drive drilling system 200 that incorporates a device 6 capable of performing the disclosed techniques. The portion of the drilling system comprises a rig structure 18 comprising a frame 20 and a pair of guide rails 22 along which a top drive assembly, generally designated 24, may ride for vertical movement relative to the rig structure 18. The rig structure 18, also commonly referred to as a derrick, may be a large load-bearing structure, usually a bolted construction of metal beams. The rig structure 18 houses the top drive assembly 24 that is used in a top drive drilling system 100 to provide drilling torque and rotations per minute (rpms) to a drill string 9. A conventional traveling block 25 and a conventional hook (not shown) may be suspended by cables from the top of the rig structure 18, and the top drive assembly 24 may be hung from the hook. The top drive assembly 24 may comprise a top drive motor 26 and a power swivel 28 that is powered by the top drive motor 26. The top drive motor 26 may be a conventional top drive motor 26 operative to rotate a drill string 9 to drill a well hole.

The drill string 9 may be formed in the usual manner of interconnecting a large number of pipes 11, such as drill pipes 5, 10, 11. The pipes may be interconnected at threaded joints 7, 8 and the lowermost pipe 12 may have a drill bit attached to the end for drilling into the earth 40. The top drive motor 26 may connect directly or indirectly to one of the uppermost drill pipes 11 in the drill string 9, such as drill pipe 5, to provide rotational torque to the string 9. For example, the uppermost portion of the drill string 9 may have a threaded end that threads to a complementary threaded end of the power swivel 28, for example. In an example configuration, the uppermost drill pipe 5 may connect to the power swivel 28 or directly to the top drive motor 26. A device 6 may be coupled to this uppermost drill pipe 5 or be otherwise incorporated between the top drive assembly 24 and the drill string 9. For example, the device 6 may be configured to connect at a first end to the top drive assembly 24 and at a second end to the uppermost drill pipe 5.

The device 6 may include sensing electronics, such as a sensor, a microcomputer, or the like. The sensor, located on a section of the drill string 9 or being part of device 6 that can be incorporated into the drill string 9, may rotate with the drill string and take measurements related to the drilling operation. For example, the sensor may measure weight, bending, or torque of the drill string 9 at this location or measure the rotation speed or revolutions per minute. Thus, the sensor may take measurements of the drill string 9 that is in proximity to the top drive assembly 24 during the drilling operation.

The device 6 may have a transmitter 4, such as a transceiver that may transmit the measurements to a coordinator 15. The transmitter 4 may wirelessly transmit the sensor information in real-time to a coordinator or main radio 15, for example, that may be located a distance away from the sensing equipment. A transmitter 4 may be located on or near the sensor taking measurements of the upper portion of the drill string 9 and may also rotate with the drill string 9. For example, similar to the sensor, the transmitter 4 may be located on an upper section of the drill string 9 or on a device 6 that is configured like a section of the drill string 9.

During the drilling operation, the top drive assembly 24 may be lowered relative to the frame 20 to advance the string 9 downwardly into the well hole. The top drive assembly 24 may be lowered via the traveling block 25, where movement is guided by hoisting equipment in the rig structure 18 that moves the top drive motor 26 upwards and downwards within the rig structure 18. For example, the top drive assembly 24 may be attached to a carriage having rollers engaging and located by rails 22. The rails 22 may be two vertical guide rails, as shown, and may be rigidly attached to the rig structure 18. The rails 22 may guide the vertical movement of the top drive assembly 24, and therefore the top drive motor 26, upwardy and downwardly along the rails 22.

The rig structure 18 includes a rig floor 30 having a central opening 32 through which a drill string 9 may extend through to drill into the formation 40. Often the rig floor 30 is a platform that is raised off of the ground, allowing access to the drill string 9 from underneath the platform and providing space for other equipment. The top drive assembly 24 may be lowered with respect to a rig structure 18, driving the drill string 9 through the opening 32 and into the earth 40. The top drive assembly 24 is typically lowered for drilling until it reaches the rig floor 30 or the surface of the earth 40, at which point more pipe may be added to continue downward advancement into the earth 40.

As drilling progresses and the length of the drill string is increased, additional drill pipe 11 may be added below the position of the device 6 such that the device 6 remains in close proximity to the top drive assembly 24. Thus, the top drive assembly, and an upper portion of the drill string 9 that is rotated by the top drive motor 32, typically operate at a point above the surface of the earth 40 during the drilling operation. Because device 6 is typically connected to or in positioned in close proximity to the top drive assembly that operates above the surface of the earth, the transmitter 4 is thereby typically positioned above the earth 40 during the drilling operation. The transmitter 4 therefore has the capability to wirelessly transmit information to a remote location at any time during the drilling operation.

Figure 3:
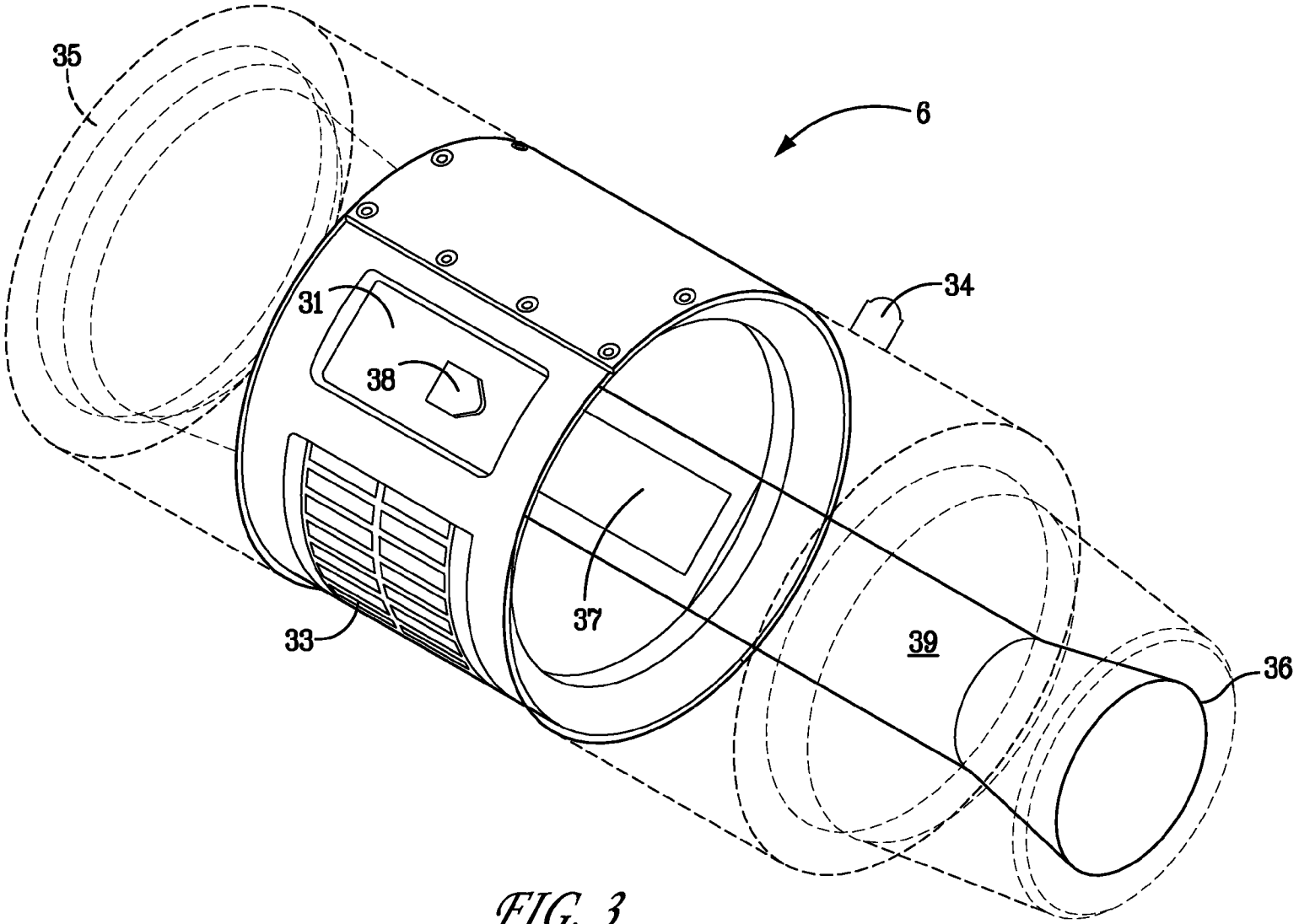
FIG. 3 shows an example device having a sensor and transmitter that may perform the disclosed techniques.

FIG. 3 shows an example device 6 that is tooled similar to a pipe section of the drill string 9. Both ends may be threaded such that the first end 35 can be threaded to the top drive or a drill pipe 5 and the second end 36 can be threaded to a drill pipe 11, as shown in FIG. 2. Alternately, the drill pipe 11 may pass through the cavity created by inner wall 39. The device 6 may include sensing electronics 31, such as a sensor, a microcomputer, or the like. The sensor(s) 31 may include or may be mounted on printed circuit boards and have associated components for storing and processing data. The sensor(s) 31 may measure various parameters of the drill string 9 (e.g., weights, torques, bending, rpms, or the like).

The device 6 may have a transmitter 38, such as a transceiver that may transmit the measurements taken to a coordinator 15. The device 6 may also have a separate receiver and transmitter. The device 6 may use control signal or beacon signal information to determine the best available coordinator 15 to which to transmit and/or the best times for transmitting during the transceiver's rotation to any particular coordinator 15. Transmission of the information with the receiving antenna over only select times of the device's rotation will efficiently transmit and thereby conserve power. The device 6 may receive and evaluate the beacon signal to determine direction information regarding the antenna visibility and when signal strength would be efficient for transmission. The device 6 may also be configured to take measurements of its own movement to facilitate the determination of the appropriate times to turn the transmitter 4 on and off as the drill rotates. For example, the tool may have a separate indicator of speed, such as a gyro-rate sensor 34.

Typically, long hours of operation of device 6 (e.g., measuring and transmitting drilling related information) are desired. Often, a limited power source, such as a battery 33, is used to power the device 6, thereby creating a need to conserve the power used during operation. Because the drill string 9 is rotating, it may be desirable to efficiently transmit the information, such as by transmitting at select times or over a select arc of the transmitter's rotational path. For example, synchronizing transmission times with the receiving antenna such that transmissions occur when the receiving antenna is visible to the transmitter 4 may conserve power. Transmitting for select periods of time or over a portion of the arc of the transmitter's rotational path may still provide the information to a fixed location antenna or router, for example, and at the same time conserve power. In an example scenario, the desired arc over which to transmit is 120 degrees, thus conserving power by transmitting over less than half of the rotational path of one rotation but still having sufficient transmission time to provide information to a coordinator 15.

To facilitate the transmission of the data over a desired arc of the transmitters' rotational path, several factors may be taken into consideration. For example, the rotational path of the transmitter 4, the speed of rotation (i.e., revolutions per minute), etc, may be used to determine the timing for transmission over a portion of the arc. In an example embodiment for transmitting over the desired arc, the transmitter 4 may be turned on or activated (i.e., in listening mode or transmitting mode) at the appropriate times within the rotational path of the transmitter 4. The appropriate times may be determined by evaluating several factors, such as the turn rate of the drill and/or transmitter 4 in revolutions per minute (rpm), power level remaining in the device's power source 33, etc.

If the device 6 detects the presence of a coordinator 15, the device 6 may use the detected beacon signal to derive the timing used by the coordinator 15. The information used to derive the timing includes the frequency location of the tones used in the detected beacon signal bursts and/or the time interval between the detected successive beacon signal bursts. The device's transceiver 4 may pass the information from the beacon signal to the device's microcontroller 37 to execute synchronization algorithms. The device 6 can synchronize its transmitter 4 and receiver to the derived timing, and then send a signal to the coordinator 15 using the derived timing in order to establish a communication link between the two terminals. The microcontroller 37 or a router 1 may also use the beacon signal information to determine the best available coordinator 15 to which to transmit and/or the best times for transmitting during the transceiver's rotation to any particular coordinator 15. Synchronizing the transmission of the information with the receiving antenna over select times of the device's rotation will efficiently transmit and thereby conserve power.

If the coordinator 15 is not fixed in one position, such as if the coordinator 15 is rotating or traveling, the strength of the beacon signal may be a function of the coordinator's 15 movement. The device 6 may receive and evaluate the beacon signal to determine direction information regarding the coordinator 15 visibility as well as signal strength, which may indicate efficient transmission times. For example, after a beacon of a coordinator 15 is acquired, the device 6 may use the beacon to accurately point the transmitter of the device 6 toward the coordinator 15, or determine at what point in the device 6's rotation the signal strength between the device and the coordinator 15 is the strongest.

In an example configuration, the device 6 calibrates with the beacon signal one time (i.e., receipt of a single beacon signal) and future transmissions are based on the arc determined from that beacon signal. In another configuration, the device 6 may calibrate with the beacon signal and re-calibrate periodically by evaluating another beacon signal. Or, the device 6 may evaluate each beacon signal received to validate or verify calibration.

The drill string 9 may not be rotating and the transmitter has a line of sight with another antenna or even the end user. However, if the coordinator 15 is in view of the transmitter 4, the transmitter 4 may still transmit to the coordinator 15 to be further transmitted to any other antennas including the end user. In this manner, the transmitter, which is typically energized via a limited-duration power source, is able to conserve power by transmitting over a shorter distance. If the coordinator 15 is not in the transceiver's field of transmission, the device's transceiver 4 may utilize a protocol to establish nodes and paths back to the end user. For example, if the drill string 9 is not rotating, and therefore the sensor and transmitter on the device 6 are not rotating, the router 1 may establish a path from the transceiver 4 to the end user 3. Multiple antennas or radios that are available for re-transmitting may be a node included in the path to accomplish transmission to the end user. For example, the ZigBee protocol may establish nodes and paths back to the end user.

The device 6 may also be configured to take measurements of its own movement to facilitate the determination of the appropriate times to turn the transmitter 4 on and off as the drill rotates. For example, the device may have a separate indicator of speed, such as a gyro-rate sensor. In this manner, the beacon signal from the antenna and measurements from the gyro-rate sensor may be used to synchronize the transmission of data with the desired arc of the tool's rotation. The information, along with accelerometer and rate sensor signals measured by the microcontroller, may provide positional data. As the device's 6 rotational rate changes, updates may be made to the transmission times or the arc over which the transceiver 4 transmits.

As described above, the transceiver 38 may be configured to monitor control signals from a coordinator 15. For example, the device 6 may be operable to receive one or more control signals being communicated from a coordinator 15. The device's microcontroller 37 may execute synchronization algorithms, using the control signals, to synchronize the device's transceiver 4 with a coordinator.

Figure 4:
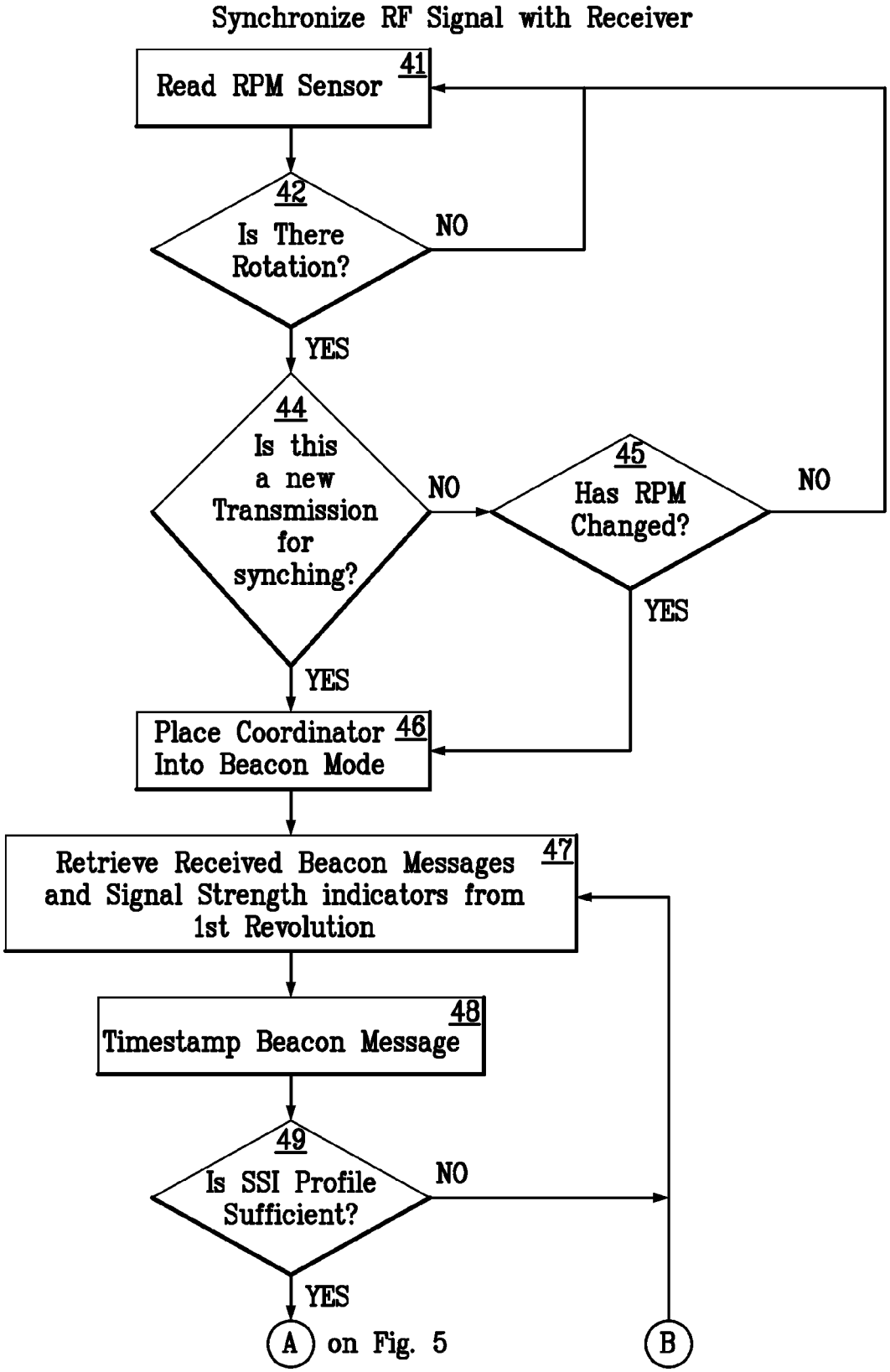
FIGS. 4 and 5 represent an example method of synchronizing a device transceiver with a coordinator.
Figure 5:
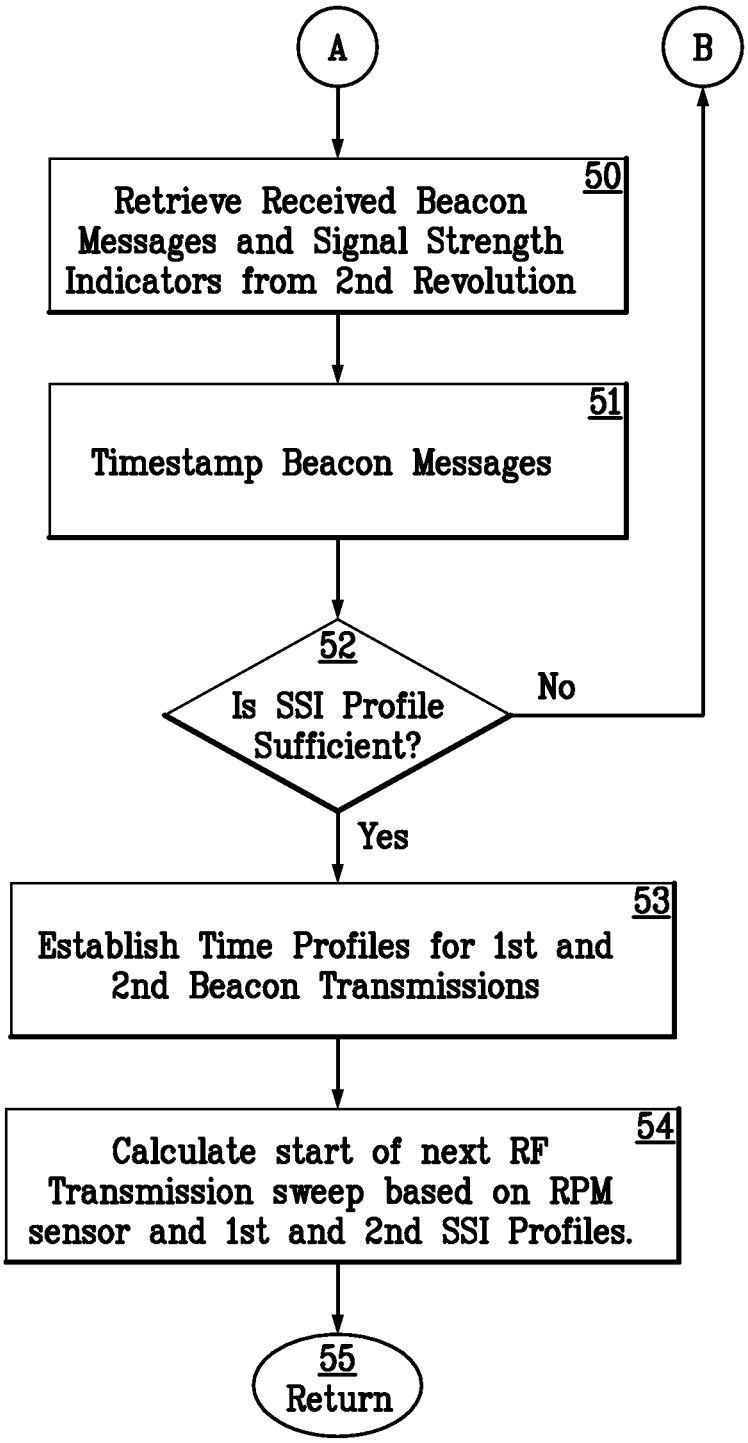

FIGS. 4 and 5 represent a method of synchronizing a device 6 transceiver with a coordinator 15. As shown at 41, an RPM sensor is read that provides the revolutions per minute of the drill string. An RPM sensor may be any sensor capable of providing rotational measurements, such as a gyro-rate sensor, for example. The device may be incorporated into the drill string or otherwise attached, as described above, thus, the RPM sensor can also provide an indication of the device's RPMs, including that of the transceiver and sensor rotating with the drill string. It is determined, at 42, whether the drill string is rotating. If it is not, then from 43 the method flows back to reading the RPM sensor at 41. Thus, the RPM sensor is monitored or read until there is rotation of the drill string at 42.

The method described in FIG. 4 contemplates the use of an RPM sensor, such as a gyro-rate sensor or other sensor for taking rotational measurements. However, it is noted that the transceiver may be synchronized to the coordinator without the RPM measurements. The use of the RPM measurements supports a synchronization process refined with respect to the rotational speed of the drill string. For example, including the RPMs of the drill string may better refine the arc of rotation selected for transmission as the speed of rotation can effect the timing and duration necessary to successfully transmit for reception.

A rotation of the drill string, identified at 42, leads to the inquiry of whether or not this is a transmission for synching, at 44. A transmission for synching may be a first transmission from a device, the first transmission to a new coordinator, a transmission that is periodically sent to re-synch the transceiver with a coordinator, or the like. If the transmission is not for synching, at 45 a verification of whether or not the RPM has changed may be evaluated. If the RPM has changed, then the method of synchronizing may continue at 46. If the RPM has not changed, and there is no other reason to synch, then the method may go into a standby mode or it may return to the monitoring of the RPM sensor at 41.

If the RPM has changed or the transmission is for synching, the coordinator is placed into beacon mode at 46. Beacon signals are primarily radio, ultrasonic, optical, laser or other types of signals that indicate the proximity or location of a device 6 or its readiness to perform a task. Beacon signals also carry several critical, constantly changing parameters, such as power-supply information, relative address, location, timestamp, signal strength, available bandwidth resources, temperature and pressure. A beacon signal may include a sequence of beacon signal bursts, each beacon signal burst including one or more beacon symbols, each beacon symbol occupying a beacon symbol transmission unit. A total air link resource, e.g., a combination of frequency and time, may be available for communication and include, from the coordinator's perspective, portions available for transmission of beacon burst signals and portions designated for other uses, e.g., beacon signal monitoring, user data signaling, and/or silence portions.

The device's transceiver 4 may scan a spectrum of interest to search for a beacon signal for the purpose of detecting the presence of a transmitting antenna, e.g., a wireless terminal or coordinator 15, obtaining some identification of that antenna, and estimating the timing and/or frequency synchronization information related to the antenna. The device 6 may continuously be in the listening mode for a certain time interval. The listening mode time may be followed by an off time during which the terminal is in a power saving mode and does not receive any signal, e.g., turn off the receive modules.

At 47, the transceiver may retreive the beacon messages and determine signal strength from a first revolution of the drill string. The received beacon messages may be timestamped at 48. If the SSI profile is sufficient at 49, then the synchronization method continues to "A" on FIG. 5. If the SSI profile is not sufficient at 49, the synchronization method returns to the step at 47 of receiving beacon messages and SSIs from the next revolution (the first revolution upon return to step 47). The signal strength refers to the magnitude of the electric field that is a distance from the transmitting antenna. Typically it is expressed in voltage per legnth or signal power received by a reference antenna and may be represented by a signal strenght indicator (SSI). An SSI profile may be sufficient if the signal strength meets a predetermined threshold. The threshold may be specific to the application, the distance from the coordinator, the power level in the device's battery, or any other parameter related to the drilling operation.

If the SSI profile is sufficient at 49, the method continues at "A" on FIG. 5. Thus, at 50, the transceiver retrieves beacon messages and signal strenght indicators from a $2^{nd}$ revolution of the drill string. The received beacon messages may be timestamped at 51. If the SSI profile associated with the $2^{nd}$ revolution is not sufficient at 52, the method returns to B on FIG. 4, which leads to step 47 and beginning the receipt of beacon messages and SSIs from a first revolution. It is contemplated that the synchronization method could be accomplished via any number of beacon signals and any number of drill string revolutions. For example, the synchronization could be based on a single beacon message during a single revolution of the drill string. Alternately, the synchronization could be based on multiple beacon mesasges and multiple revolutions of the drill string.

If the SSI profile associated with the $2^{nd}$ revolution is sufficient at 52, then time profiles for the first and second beacome transmission is determined at 53. As shown for this example synchronization method, at 54 the transceiver may calculate the start of the next RF transmission sweep based on the RPM sensor and the first and second SSI profiles. As described above, to conserve power, the device 6 may also consider the power level remaining in the device's power source. Thus, as a result of the method of synchronization shown in FIG. 4 and FIG. 5, the transceiver or other processor of the device may determine when to start a transmission (e.g., at what point in the drill string's arc of rotation) as well as how long to transmit for, and when to stop transmitting. The transmission may be an RF transmission. The device's microcontroller may execute synchronization algorithms, using the control signals, to synchronize the device's transceiver 4 with the coordinator's transceiver in time and frequency as described above.

Figure 6:
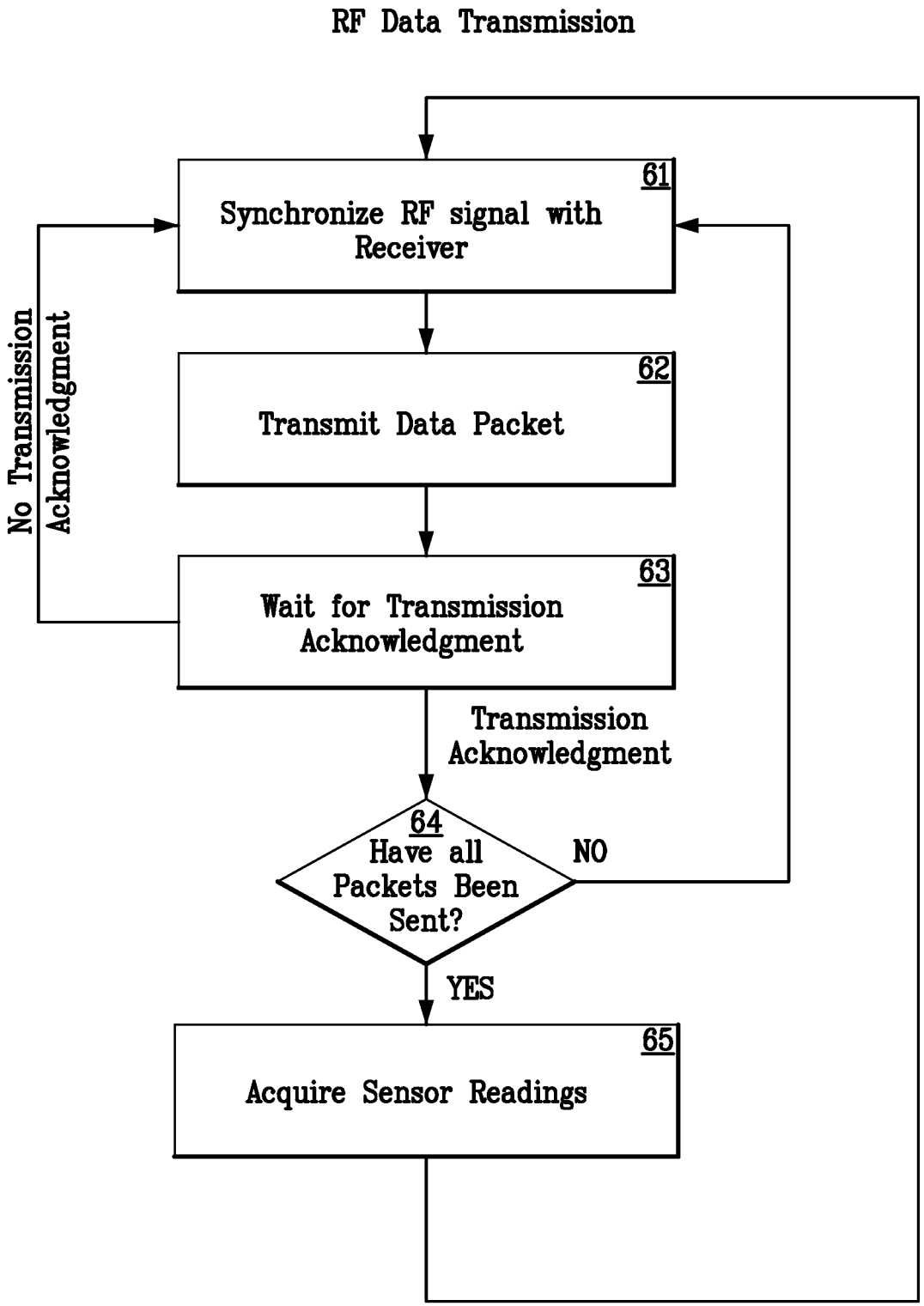
FIG. 6 represents a method of radio frequency data transmission from a device transceiver.

Following the synchronization of the signal with the receiver, FIG. 6 shows an example method of wireless transmission from the transceiver. In this example, the transciever uses RF transmission to transmit information. At 61, the device 6 may synchronize to a coordinator 15 as described above with respect to FIG. 4 and FIG. 5. The device may transmit a data packet, at 62, that comprises beta information or a test message, for example, and information measured by the sensor. For example, the message may include a header that performs handshaking, followed by bytes of information gathered during the drilling operation. At 63, the device 6 waits for a transmission acknowledgement from a receiving coordinator 15. If a transmission acknowledgement is not received, the method may return to step 61 and initiate the synchronization method again. An error message may be displayed in some manner to an operator. If, after a predetermined number of times of performing the synchronization method a transmission acknowledgement is not received, an alert may be provided indicating that a operator intervention is suggested, such as verifying that the coordinator is located properly or that the device is receiving power.

Figure 7:
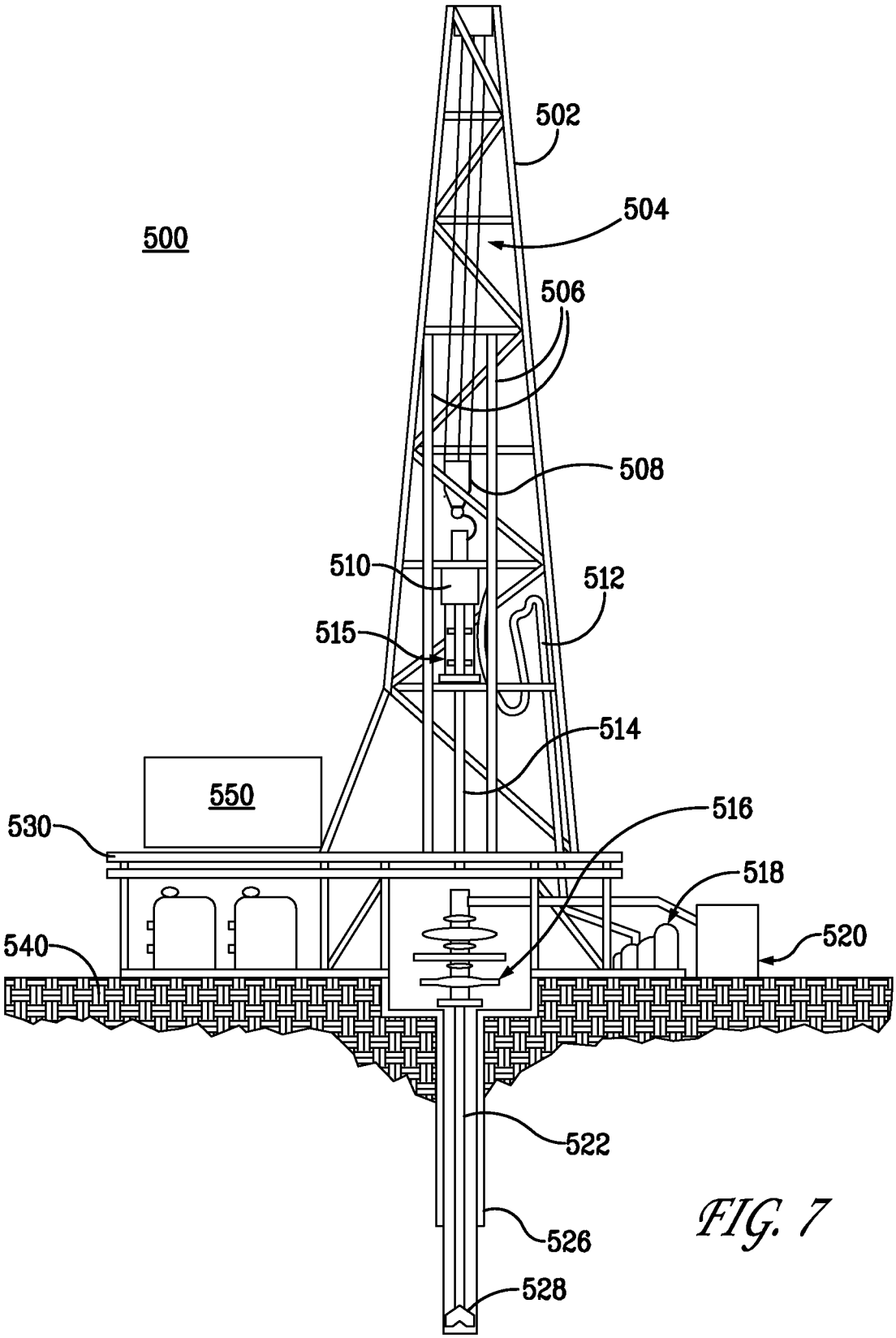
FIG. 7 depicts an example drilling system employing a mud pulse telemetry system that may be used to perform the disclosed techniques.

At 64, if all of the data packets have been sent, the device 6 will acquire its sensor readings (e.g., drill string 9 parameters) for transmission at 65. The last data packet to be sent may include an indication in the header that it is the last message in the series for receipt. If all of the data packets have not been sent at 63, the synchronization process may continue, starting again at 61. For example, if the rotational arc selected for transmission was not sufficient to transmit all of the information sent by the device 6, or not properly selected for transmission to a particular coordinator 15, the device 6 may need to continue the synchronization process FIG. 7 depicts an example top drive drilling system 500 that may operate with the disclosed techniques. The example drilling system 500 comprises a rig structure 502, drilling cables 504, rails 506, a traveling block 508, a top drive motor 510, a mud pump 518, drill pipe sections 514 and 522 (collectively referred to as the drill string), and a device 515. The rig structure 502, also commonly referred to as a derrick, may be a large load-bearing structure, usually a bolted construction of metal beams, having a rig floor 530, or platform, at its base. The rig structure 502 houses the top drive motor 510 that is used in a top drive drilling system 500 to provide drilling torque and rotations per minute (rpms) to the drill string. A conventional traveling block 508 and a conventional hook (not shown) may be suspended by cables 504 from the top of the rig structure 502, and the top drive motor 510 may be hung from the hook. The rig floor 530 may contain an opening through which drill string 522 extends downwardly into the earth 540 to bore a hole. The driller's control cabin 550 or station may sit on the rig floor 530. A blowout preventer 516 may be attached to the top of the drill pipe 522. The blowout preventer 516 is a stack of hydraulic rams which can close off the well instantly if back pressure (a kick) develops from invading oil, gas or water.

In a top drive drilling system 500, hoisting equipment in the rig structure 502 may move the top drive motor 510 upwards and downwards within the rig structure 502. For example, the top drive motor 510 may be part of a drilling unit that is attached to a carriage having rollers engaging and located by rails 506, further guided for vertical movement upwardy and downwardly along the rails 506. The rails 506, which may be two vertical guide rails or tracks rigidly attached to the rig structure 502, may guide the vertical movement of the top drive motor 510. The top drive motor 510 may connect to the upper end of the drill string, drill pipe 514, providing rotational torque to the drill string. The drill bit 528, attached to the end of drill pipe 522, is the cutting or boring element, usually making up the distal end of the drill string. The drill bit 528 functions to drill the bore hole into the formation 540. The drilling unit may move downward, guided by the rails 506, to advance the drill bit 528 into the earth 540, drilling even further into the formation 540. The top drive motor 510, therefore, moves downwardly with the drill string during the drilling operation while rotating the drill string from the top of the string. When the top drive motor 510 reaches the platform 530 or floor height, new sections of drill pipe may be needed to continue downward advancement into the earth 540. The drill pipe sections may be added below device 515 such that device 515 remains in proximity to the top drive motor 510.

Thus, the top drive motor 510, and an upper portion of the drill string 514 that is rotated by the top drive motor 510, typically operate at a point above the surface of the earth 540 during the drilling operation. Device 515 may take measurements of the upper portion of the drill string, drill pipe 514, via a sensor and transmit the information via a transmitter. Because the device 515 is typically connected to or is positioned in close proximity to the top drive motor 510 that operates above the surface of the earth, the transmitter is thereby typically positioned above the earth 540 during the drilling operation. The transmitter therefore has the capability to wirelessly transmit information to a remote location at any time during the drilling operation.

This example drilling operation, which is a mud pulse telemetry system, uses a mud pump 518 to pump drilling mud downward through the drill string and into the drill bit 528. Drilling fluid or mud may be contained in a mud pit 520 and a mud pump 518 may pump the drilling fluid into the drill string, such as via the standpipe 512. A mud pump 518 is typically a high-pressure reciprocating pump used to circulate the mud on a drilling rig. The standpipe 512 may be a conduit that provides a pathway for the drilling mud to travel up the rig structure 502 and then drilled downward through the drill string and into the drill bit 528. For example, during the drilling operation, drilling mud may be pumped from the mud pump 518 through the standpipe 512, down the drill string, and out through ports in the drill bit 528. The drilling mud, with the cuttings from the bore 526, may circulate upward in the annulus between the outside of the drill string and the periphery of the bore 528, lubricating the bit and carrying formation cuttings to the surface of the earth 540. The mud may be pumped into a mud pit 520 and cleaned, then pumped and circulated back down the drill pipe 514, 522 to pick up more cuttings.

Mounted at the bottom of the drill string may be a bottom hole assembly that takes measurements, processes, and stores information about the downhole drilling operation. Downhole measurements may be used to determine physical, chemical, and structural properties of the formation 540 penetrated by the drill bit 528. Downhole measurements may include information about the formation being drilled and about the downhole sections of the drill string and the drill bit.

A surface assembly may relay downhole sensing information from the sensing equipment downhole to the uphole sensor and/or transmitter 4. For example, in an example drilling configuration, a downhole electric transmitter may induce an electric current in the drill string that contains encoded information of downhole conditions. The electric current can travel up the drill string to be processed uphole. An example system that functions using mudpulse telemetry and utilizes the disclosed techniques is depicted in FIG. 7. In this example, the surface equipment may sense pressure pulses from the circulating mud and transmit the information via mud that flows through or around the drill pipe. Thus, the uphole sensor can receive the downhole information using known methods (e.g., through the mud) and then wirelessly transmit the downhole information to a coordinator, while rotating and during the drilling operation, by utilizing the disclosed techniques. For example, the wireless transmission from the uphole sensor to the coordinator, which may comprise both uphole and downhole measurements, may be accomplished vi a radio frequency (RF) link. Alternately, the data may be stored downhole and retrieved via other methods at the surface upon removal of the drill string.

Sensing elements located at the top of the drill string, as part of device 515, may measure uphole measurements in connection with drilling operation, such as weights, torques, bending, etc, that occur or effect the top of the drill string, such as drill pipe 514. Uphole measurements are those measurements of the drilling operation taken above the horizontal (i.e., above the surface of the earth or the surface of the rig structure). These measurements may be transmitted, during the drilling operation, to another location, such as to cabin 550. For example, a radio telemetry system that incorporates sensing elements may be located on the surface of the drill string. A transceiver may transmit this information to a drilling operator located in a cabin 550, such as cabin 550, for example. Because the upper portion of the drill string is typically rotating above the surface of the earth, the transmitter may wirelessly transmit drill string information in real-time to a coordinator during the drilling operation.

While the disclosed techniques have been described in connection with the example embodiments of the various figures, it is to be understood that other similar embodiments may be used or modifications and additions may be made to the described embodiment for performing the same function of the presently disclosed techniques without deviating therefrom. For example, the presently disclosed techniques may be implemented in any suitable wireless network and the device, including the sensor and transmitter, may be any component capable of performing the disclosed techniques. Thus, the presently disclosed techniques should not be limited to any single embodiment, but rather should be construed in breadth and scope in accordance with the appended claims.

What is claimed:

1. A method of synchronizing a rotating transceiver for transmission during a drilling operation employing a rotating drill string, the method comprising:

(a) receiving information representative of the rotational speed of the drill string;

(b) receiving a beacon message and a signal strength indicator from a coordinator;

(c) if the signal strength indicator meets a threshold level, selecting (i) the start time to transmit information associated with the drilling operation, and (ii) the length of time over which to transmit said information associated with said drilling operation, wherein the selected start time and length of time over which to transmit is varied based on the information representative of the rotational speed of the rotating drill string received in step (a) and the signal strength indicator received in step (b); and (d) transmitting the information, from an uphole location during the drilling operation, at the start time and over the length of time selected in step (c).

2. The method in accordance with claim 1, further comprising requesting that the coordinator be put into beacon mode.

3. The method in accordance with claim 1, further comprising timestamping the received beacon message.

4. The method in accordance with claim 1, wherein the beacon message comprises at least one of power-supply information, relative address, location, timestamp, signal strength, available bandwidth resources, temperature and pressure associated with the coordinator.

5. The method in accordance with claim 1, further comprising receiving a second beacon message and a second signal strength indicator from the coordinator, wherein if the second signal strength indicator meets a second threshold level, the step of selecting the the start time and length of time over which to transmit information associated with the drilling operation in step (c) is further based on the second beacon message.

* * * * *